United States Patent [19]

Yearout

[11] 4,289,515

[45] Sep. 15, 1981

[54] PRODUCTION OF NITROGEN BY AIR SEPARATION

[76] Inventor: James D. Yearout, 270 Portofino Way #303, Redondo Beach, Calif. 90277

[21] Appl. No.: 178,294

[22] Filed: Aug. 15, 1980

[51] Int. Cl.[3] ..... F25J 3/04

[52] U.S. Cl. ..... 62/13; 62/18; 62/38; 62/29

[58] Field of Search ..... 62/38, 29, 13–15, 62/18

[56] References Cited

U.S. PATENT DOCUMENTS

| | | | |
|---|---|---|---|
| 1,626,345 | 4/1927 | Le Rouge | 62/38 |
| 2,861,432 | 11/1958 | Haselden | 62/38 |
| 3,264,831 | 8/1966 | Jakob | 62/29 |
| 3,492,828 | 2/1970 | Ruckborn | 62/38 |

*Primary Examiner*—Norman Yudkoff
*Attorney, Agent, or Firm*—Max Geldin

[57] ABSTRACT

Production of nitrogen from air, by compressing air to relatively low pressure, e.g. to about 3 atmospheres, and passing the compressed feed air to alternate passages of a reversing heat exchanger in heat exchange relation with an oxygen-rich waste stream, whereby water vapor and $CO_2$ in the feed air are frozen on the surface of the heat exchange passage. By reversing the flow streams the low pressure oxygen-rich waste stream now flows through the feed air passage. This causes sublimation or evaporation of the $CO_2$ and water vapor. A portion of the feed air is withdrawn at an intermediate point in the exchanger and is expanded in a turbine. The cooled feed air withdrawn from the heat exchanger is fed to a non-adiabatic fractionating device, whereby oxygen-rich liquid is condensed and withdrawn, and nitrogen is removed as overhead. The oxygen-rich liquid is mixed with the portion of feed air discharged from the turbine, and such mixture, and the nitrogen overhead are passed through the fractionating system in heat exchange relation with and countercurrent to the feed air being separated in the fractionation zone. The waste oxygen-rich stream exiting the heat exchange passage of the fractionating zone is passed through one of the reversing passages of the reversing heat exchanger, the fractionation being carried out so that there is only about a 3° R temperature difference between the waste oxygen-rich stream and the feed air at the cold end of the reversing heat exchanger. The nitrogen product is passed through a separate passage of the reversing heat exchanger also in countercurrent heat exchange relation with the feed air.

18 Claims, 3 Drawing Figures

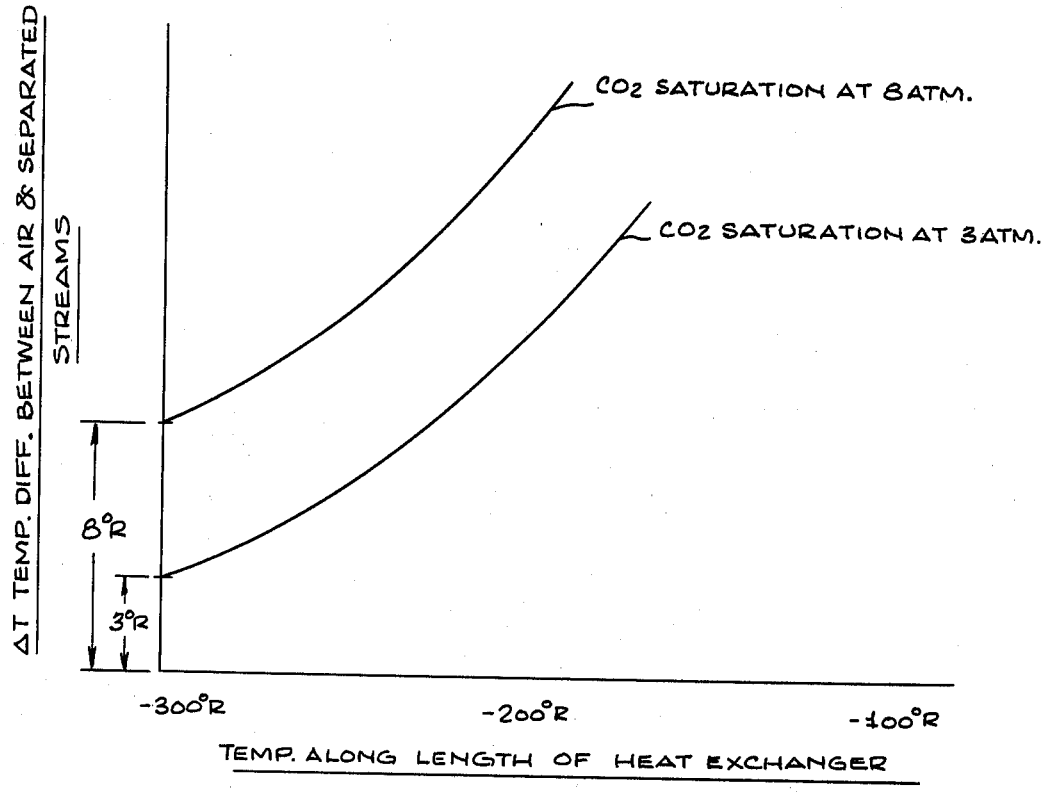
FIG. 1
FIG. 3
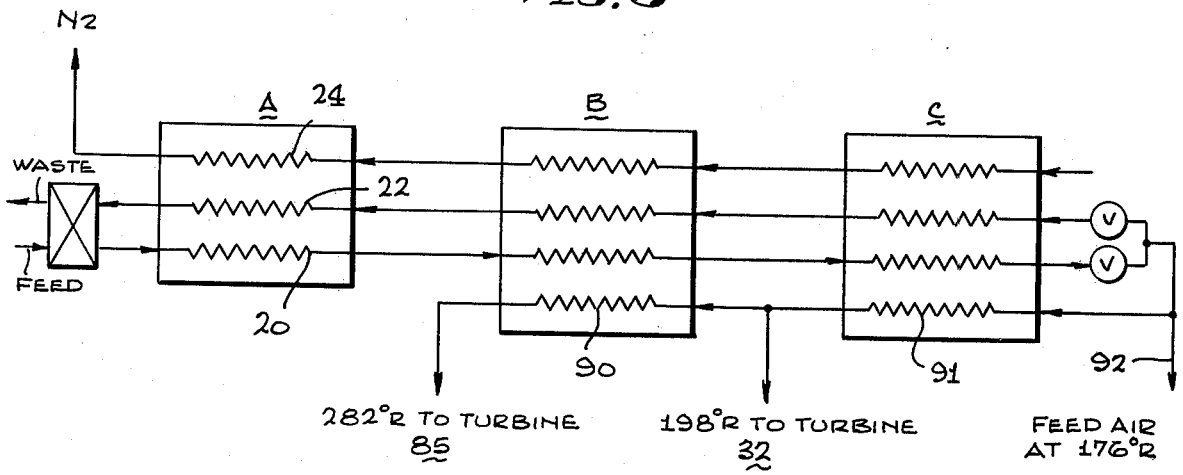

PRODUCTION OF NITROGEN BY AIR SEPARATION

BACKGROUND OF THE INVENTION

This inve .tion relates to the separation of nitrogen from air by rectification, and is particularly concerned with improved procedure for the separation of nitrogen from air employing a non-adiabatic air fractionating system, in conjunction with a reversing heat exchanger for removal of water vapor and carbon dioxide, from the feed air.

In the prior art for production of oxygen and nitrogen from air, carbon dioxide and water vapor have been removed from the feed air by external means, such as molecular sieves, as exemplified by U.S. Pat. No. 3,594,983. However, molecular sieves used for this purpose are bulky, heavy and relatively expensive.

In U.S. Pat. No. 3,508,412 for production of nitrogen by air separation, compressed air is cooled in a regenerative cooler in countercurrent heat exchange relation with oxygen-rich vapor and nitrogen.

The most economical method for removing carbon dioxide and water vapor from the feed air is to deposit the $CO_2$ and water vapor, in solid form on the surface of the regenerative heat exchanger, and, by reversing the flow passages between the incoming feed air and the low-pressure oxygen-rich waste stream, these contaminants are sublimated off the heat exchange surface into the vapor phase. However, such regenerative heat exchangers have generally been employed with a high feed air pressure, e.g. of the order of about 10 atmospheres.

It is an object of the present invention to provide a process and system to separate nitrogen from air by rectification while reducing power consumption as low as possible, by reducing the pressure of the feed air, preferably to about 3 atmospheres, or less.

Another object is to employ reversing heat exchangers for carrying out water vapor and carbon dioxide removal from the feed air at pressures at or below 3 atmospheres.

Another object is to carry out separation of nitrogen from air using reversing heat exchangers in conjunction with an air fractionation system, for removal of carbon dioxide and water vapor while maintaining an air feed pressure of not more than about 3 atmospheres.

Yet another object is to enable production of both liquid and gaseous nitrogen product, while still maintaining air purification employing the above process and system utilizing reversing heat exchanges.

SUMMARY OF THE INVENTION

It has been found that the ability of the oxygen-rich waste stream to carry off the $CO_2$ and water vapor contamination from the feed air employing a reversing regenerator, in a process of the type disclosed in above U.S. Pat. No. 3,508,412, employing differential distillation for separating air, depends upon two factors: namely the pressure difference between the incoming air and the oxygen-rich waste stream and (2) temperature difference between these two streams.

As the feed air pressure is reduced, resulting in lower energy consumption, the temperature difference between the above two streams at the cold end of the heat exchanger becomes more critical to enable removal of $CO_2$ and water vapor. As the feed air pressure is reduced, the temperature differential between the feed air and the waste stream at the cold end of the reversing regenerator must be very carefully controlled.

This in turn requires that the heat and mass transfer relationships within the zone of the fractionating system be very carefully arranged so that the temperature difference between the feed air, and the returning oxygen-rich waste stream and nitrogen product stream, is very small, that is 3° R at 3 atmospheres pressure.

According to the present invention, production of nitrogen from air is carried out by compressing air, e.g. to about 3 atmospheres, and passing the compressed feed air to alternate passages of a reversing heat exchanger in heat exchange relation with an oxygen-rich waste stream, whereby water vapor and $CO_2$ in the feed are frozen on the surface of the heat exchange passage. By reversing flow streams so that the low pressure oxygen-waste stream now flows through the feed air passage, this causes sublimation and evaporation of the $CO_2$ and water vapor.

In preferred operation, a portion of the feed air is withdrawn at an intermediate point in the reversing exchanger and is expanded in a turbine.

The air passing through the heat exchanger is fed through a non-adiabatic fractionating device for carrying out a differential distillation, whereby oxygen-rich liquid is condensed and withdrawn, and nitrogen is withdrawn as overhead. The oxygen-rich liquid can be mixed with the portion of feed air discharged from the turbine and such mixture, as well as the nitrogen overhead product, are passed through the fractionation system in countercurrent heat exchange relation to the feed air being separated in the fractionation zone. The waste oxygen stream exiting the heat exchange passage of the fractionating zone is passed through the reversing passages of the reversing heat exchanger, and the fractionation is carried out so that there is only about a 3° R temperature difference between the waste oxygen stream and nitrogen product stream, and the feed air at the cold end of the reversing heat exchanger. The nitrogen product stream is passed through a separate passage of the reversing heat exchanger. According to the invention process, the nitrogen gas at the overhead of the fractionator is warmed in the countercurrent heat exchange passage by the partially condensing feed air exiting the bottom of the fractionating device. The fractionation process is carried out under conditions such that the oxygen-rich fluid, as well as the nitrogen product, both removed from separate heat exchange passages of the fractionator, are within 3° R of the incoming feed air at the cold end of the regenerative heat exchanger.

On the other hand, in the process of my above U.S. Pat. No. 3,508,412 the nitrogen enters the regenerative cooler approximately 10° R below the dew point of the feed air.

That portion of the feed air which is removed at an intermediate point in the reversing regenerative heat exchanger is tapped from the exchanger at a point upstream or above the cold end of the exchanger, thereby creating a mass imbalance in the cold portion of the exchanger. This creates a temperature pinch ($\Delta T$) at the cold end of the exchanger, thereby insuring complete sublimation of the solid $CO_2$, from the feed when the waste oxygen and the feed air passages are reversed to permit the waste stream to pass through the passages previously occupied by the feed stream. The warmer air so tapped is first passed through an absorbent trap prior to expansion, for removal of the final traces of $CO_2$ and hydrocarbons.

On the other hand, when employing higher feed pressures of the order of 8 atmospheres, e.g. as in the above U.S. Pat. No. 3,508,412, the temperature difference between the feed air and the separated streams passing through the regenerative cooler is of the order of 8° R. If the temperature difference between the incoming air stream, and the nitrogen product and oxygen-rich waste streams at the cold end of the reversing regenerator is greater than 3° R, when operating at a feed pressure of 3 atmospheres, using the process of the above patent, the waste stream will not pick up and remove the $CO_2$, which would plug the regenerator. These relationships are illustrated in FIG. 1 of the drawing.

There is an additional difficulty employing the reversing exchangers when liquid nitrogen is the desired product. Due to the mass imbalance in the return waste and product streams, the $\Delta T$ profile in the exchanger prior to the turboexpander tap is no longer constant but the $\Delta T$ increases as the temperature decreases. This phenomenon limits the amount of liquid which can be withdrawn as product. This difficulty can be resolved by adding a second turboexpander at a tap warmer than, that is upstream from, the first expander, with the cooled turbine exhaust returning to the waste stream at the location of the first expander tap.

The process for the separation of nitrogen from air, according to the invention basically comprises:

compressing feed air containing water vapor and $CO_2$, to relatively low pressure, passing the compressed feed air stream through a first passage of a reversing heat exchanger in heat exchange relation with an oxygen-rich waste stream passing through a second passage of said heat exchanger, whereby water vapor and $CO_2$ in the feed air are frozen on a surface of said first heat exchange passage, reversing the two streams whereby the oxygen-rich waste stream flows through said first passage and said feed air stream flows through said second passage, causing sublimation or evaporation of said water vapor and said $CO_2$, at the end of this cycle, again reversing the two streams so that the compressed feed air stream passes through said first passage and the oxygen-rich waste stream passes through said second passage, and repeating the cycle at predetermined intervals, withdrawing a portion of the feed air stream at an intermediate point in the heat exchanger, expanding said withdrawn portion of feed air in an expander and discharging cooled expanded air, withdrawing the remainder of said cooled feed air stream from the cold end of said heat exchanger after complete passage therethrough, passing said cooled feed air stream upwardly in a fractionating column in a fractionating device, whereby oxygen-rich liquid is condensed, and a nitrogen overhead is produced, withdrawing said oxygen-rich liquid from said fractionating column, throttling said withdrawn oxygen-rich liquid to lower pressure, and mixing the throttled liquid with said cooled expanded air discharged from said expander, passing said mixture and said nitrogen overhead through separate passages in said fractionating device in countercurrent heat exchange relation with the feed air in said fractionating column, and withdrawing heat from said column, and withdrawing said mixture from said fractionating device and passing said mixture forming said waste oxygen-rich stream into the cold end of said heat exchanger through one of the first and second passages of the reversing heat exchanger as aforesaid, said heat exchange in said reversing heat exchanger and said fractionation being carried out under conditions such that there is only a small temperature difference between the waste oxygen-rich stream entering the cold end of the exchanger and the cooled feed air stream exiting the cold end of the heat exchanger.

THE DRAWINGS

FIG. 1 shows the temperature difference between the feed air stream and the oxygen-rich waste stream along the length of the reversing heat exchanger;

FIG. 3 is a modification of the reversing heat exchanger using a Trumpler pass instead of gel traps.

DETAILED DESCRIPTION OF THE INVENTION AND PREFERRED EMBODIMENTS

Figure 2:
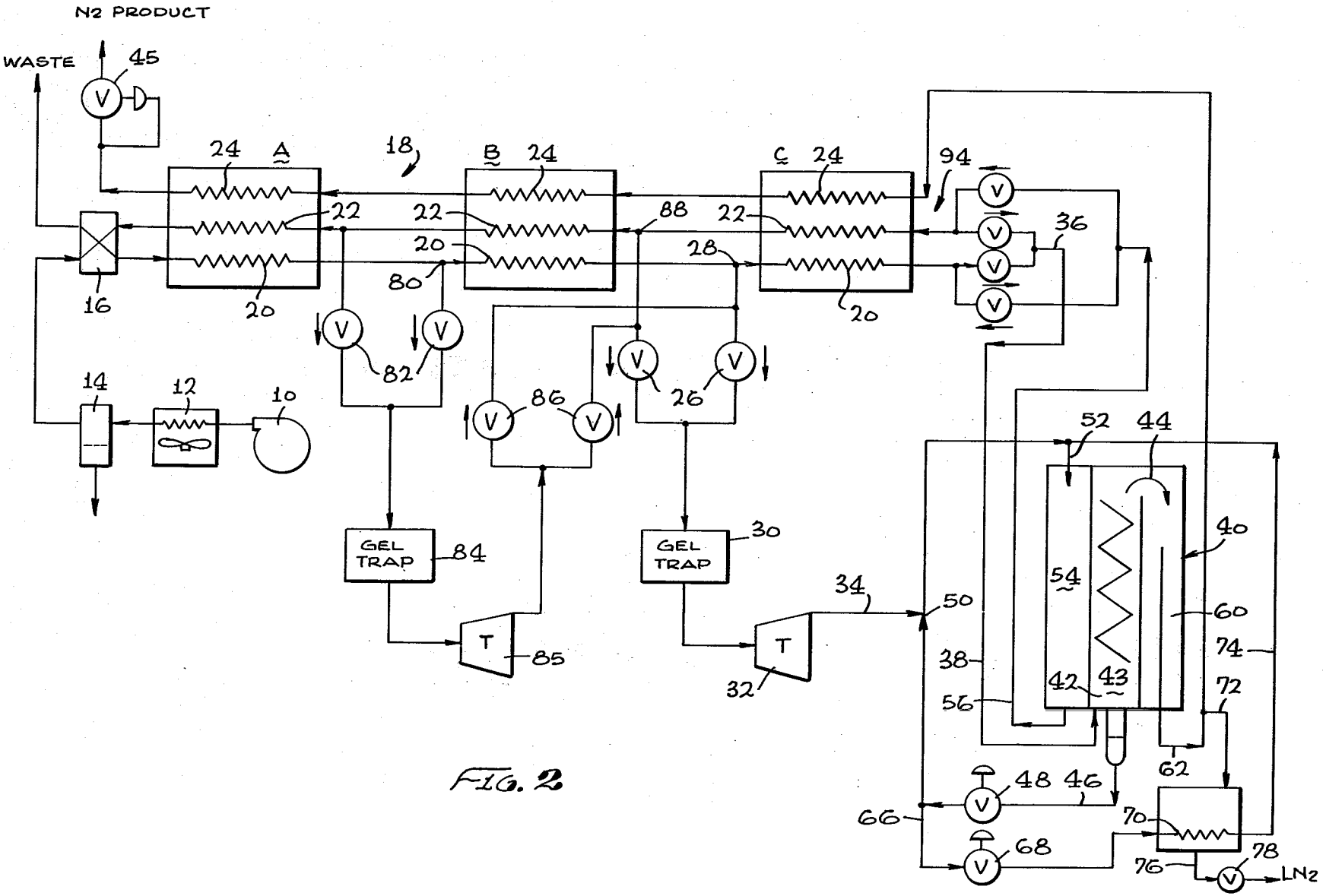
FIG. 2 is a schematic flow diagram of a preferred mode of operation.

Referring to FIG. 2 of the drawing, air is compressed at 10 to about 3 atmospheres, cooled to near ambient temperature at 12 and free water is separated in a separator at 14. The air feed then enters a reversing regenerative heat exchanger, indicated generally at 18, through a reversing valve 16, which is connected to two passages 20 and 22 of the reversing regenerative heat exchanger 18, comprised of three units A, B and C. The heat exchanger contains heat exchange passages 20 for feed air and 22 for the waste or the waste oxygen-rich air stream, and also a heat exchange passage 24 for nitrogen product.

Reversing valve 16, together with the check valve assemblies such as 26, described more fully hereinafter, cause the feed air at 3 atmospheres in passage 20 to alternate passages with the oxygen-rich waste stream, which is at one atmosphere in passage 22. As the feed air in 20 is cooled in countercurrent heat exchange with the oxygen-rich waste stream at 22 and the nitrogen product in 24, water vapor and $CO_2$ are frozen on the surface of the heat exchange passage 20. After a predetermined period of time, e.g. $7\frac{1}{2}$ minutes, the reversing valve 16 actuates to direct the feed air to the passage 22 previously occupied by the waste stream, and the low pressure waste stream flows through the passage 20 previously occupied by the air stream, sublimating and evaporating the frozen deposits of $CO_2$ and water vapor.

In a typical plant, the heat exchanger is designed so that a complete reversing cycle occures every 15 minutes.

A portion of the feed air is withdrawn from the exchanger at a tap point 28, with a temperature of about 198° R, and is passed via check valve 26 through a gel trap 30 which can contain silica gel, charcoal, or a molecular sieve, to remove the last traces of $CO_2$, and the air is then expanded in a turbine 32, and discharged at 34 at approximately 1 atmosphere and 153° R.

The remainder of the air feed is further cooled in passage 20 of unit C of the heat exchanger 18, exiting at 36 at about 176° R. The cooled air is then fed via line 38 to the fractionating device indicated at 40, entering the bottom 42 of the fractionating column 43 of such device. In the column, as a result of non-adiabatic differential distillation taking place therein, oxygen-rich liquid is progressively condensed from the vapor moving upward, until pure nitrogen is taken off as overhead at 44. The nitrogen product pressure is maintained at 3 atmospheres by the back pressure regulator 45. The oxygen-rich liquid withdrawn at 46 from the bottom of the fractionating column is throttled from 3 atmospheres to 1 atmosphere by the liquid level control valve 48, and is mixed at 50 with the turbine exhaust at 34. The resulting mixture is introduced at 52 into the top of the fractionating device 40 and flows counter-current to the air being separated in the fractionating zone 43, in heat exchange passage 54, and exits the bottom of the fractionating device at 56 and enters the cold end 94 of heat exchanger 18, at a temperature of about 173° R, or only 3° R colder than the feed air temperature exiting unit C of the heat exchanger at 36.

Similarly, the product nitrogen at 44 flows through a heat exchange passage 60 downwardly within the fractionation device 40 and exits at 62 and enters the cold end 94 of exchanger 18, also at about 173° R.

This close temperature approach has been found essential to the proper functioning of the reversing exchanger, as noted above.

The fractionating device 40 is of a type similar to that shown in my above U.S. Pat. No. 3,508,412.

The exiting oxygen-rich air stream at 56 enters passage 22 of heat exchanger 18 at the cold end 94 thereof, and is discharged via valve 16 as waste. The nitrogen stream at 62 enters passage 24 at the cold end 94 of the heat exchanger 18 and is discharged via valve 45 as $N_2$ product.

If liquid product is desired, a portion of the oxygen-rich liquid at 46 is diverted at 66 via valve 68 and passed through a nitrogen condenser 70 in heat exchange relation with a portion of the nitrogen in line 62, bypassed at 72 to the condenser. The cold oxygen-rich vapor discharged from the condenser at 74 is returned to the top of the heat exchange pass 54 of the fractionating system or device 40. The liquid nitrogen product at 76 is recovered via valve 78.

There is an additional difficulty with the reversing exchangers when liquid nitrogen, as described above, is a desired product. Due to the mass imbalance in the return stream in the regenerator, the $\Delta T$ profile, that is, the difference in temperature between the return streams and the air feed in the exchanger upstream of the turboexpander tap at 28 is no longer constant, but the $\Delta T$ increases as the temperature of the air feed decreases. This phenomenon limits the amount of liquid which can be withdrawn as product.

This difficulty can be resolved by adding a second intermediate tap at 80 in the heat exchanger at a warmer location than the first tap at 28. Part of the feed air is withdrawn at about 260° R, and after passing through check valve 82 and gel trap 84, is expanded through turbine 85 to 1 atmosphere at about 198° R. The cold expanded air then passes through check valve assembly 86 and enters the waste stream 22 at a point 88 in the exchanger, and at approximately the point 28 where air is withdrawn for passage through the first turbine 32.

According to a modification shown in FIG. 3, Trumpler passes, indicated at 90 and 91, provided in units B and C of the reversing exchanger, can be used instead of the air bleeds at 28 and 80. Feed air is cooled completely to 176° R at the cold end of the heat exchanger, at 92. Then the portion which is to be expanded in the turbine 32 is warmed to 198° R in the Trumpler pass 91 of unit C. The remaining portion of the air which is to be fed to turbine 85 is further warmed to 282° R by passage through the second Trumpler pass 90 of unit B. The Trumpler pass is useful in certain instances, because it eliminates the gel traps at 30 and 84, and some of the check valves, i.e. 26 and 82. This decreases the cost of the equipment and the maintenance, but the disadvantage is that it cannot handle load changes. Accordingly, the Trumpler pass should be used where only a constant load is maintained.

If nitrogen gas only is desired, it is not necessary to tap off the air stream at 80, or use the second Trumpler pass 90, and it is not necessary to use the second turbine 85.

If liquid nitrogen only is desired, so that all of the nitrogen at 62 is condensed in condenser 70 and removed as product, no nitrogen product stream is passed through passage 24 of the regenerative exchanger 18.

Thus, the present invention involves several novel features. One of these features is the manner in which the heat exchange in the reversing heat exchanger 18 and the mass transfer zone in the non-adiabatic differential distillation device 40 are arranged to result in the temperature of both the waste oxygen-rich stream and the nitrogen product stream leaving the distillation device, being at a temperature only a few degrees, that is only 3° R, below the feed air temperature at the cold end of the regenerative heat exchanger. This permits facile removal of solid carbon dioxide and water from the feed air passages by the waste stream during reversal of the feed air and waste streams.

Both the nitrogen product stream and the refrigeration stream which includes the waste oxygen-rich stream, pass in countercurrent heat exchange relation with the feed air in the mass transfer fractionation zone 43, to maintain the low temperature difference between the waste and product streams 22 and 24, and the feed air stream 20 at the cold end 94 of the reversing heat exchanger.

Another novel feature is the manner of locating the feed points for the two turboexpanders to maintain a correct temperature profile throughout the entire heat exchanger so as to permit the use of reversing exchangers while producing liquid nitrogen product, nitrogen gas product, or a mixture thereof. If only liquid nitrogen is produced, heat exchange passage 24 is not utilized.

Thus, for example, the bleed tap at 28 for turbine 32 imbalances the mass flow so that the temperature at the exit of the exchanger can be pinched to as small a temperature difference as required.

As previously pointed out, the second turbine 85 is employed when liquid nitrogen is withdrawn. The withdrawal of the liquid nitrogen starts to affect the mass imbalance in the lower temperature portion of the heat exchanger so that the temperature difference in the heat exchanger at the point where mass is withdrawn to feed the first turbine is too great to effect $CO_2$ removal in the reversing exchanger. Therefore, a second turbine is employed with a warmer inlet temperature to create a mass imbalance in the intermediate section of the reversing exchanger and thereby keeping the temperature difference throughout the entire length of the heat exchanger under acceptable limits for $CO_2$ removal.

From the foregoing, it is seen that the invention provides a novel process and system for separating nitrogen from air, employing a differential distillation apparatus in conjunction with a reversing regenerative heat exchanger under process conditions such that the $CO_2$ and water frozen in the feed air passages can be readily removed from the heat exchangers.

While I have described particular embodiments of the invention for purposes of illustration, it will be understood that various changes and modifications within the spirit of the invention can be made, and the invention is not to be taken as limited except by the scope of the appended claims.

What is claimed is:

1. A process for the separation of nitrogen from air, which comprises:

compressing feed air containing water vapor and $CO_2$, to relatively low pressure, passing the compressed feed air stream through a first passage of a reversing heat exchanger in heat exchange relation with an oxygen-rich waste stream passing through a second passage of said heat exchanger, whereby water vapor and $CO_2$ in the feed air are frozen on a surface of said first heat exchange passage, reversing the two streams whereby the oxygen-rich waste stream flows through said first passage and said feed air stream flows through said second passage, causing sublimation or evaporation of said water vapor and said $CO_2$, at the end of this cycle, again reversing the two streams so that the compressed feed air stream passes through said first passage and the oxygen-rich waste stream passes through said second passage, and repeating the cycle at predetermined intervals, withdrawing a portion of the feed air stream at an intermediate point in the heat exchanger, expanding said withdrawn portion of feed air in an expander and discharging cooled expanded air, withdrawing the remainder of said cooled feed air stream from the cold end of said heat exchanger after complete passage therethrough, passing said cooled feed air stream upwardly in a fractionating column of a fractionating device, whereby oxygen-rich liquid is condensed, and a nitrogen overhead is produced, withdrawing said oxygen-rich liquid from said fractionating column, throttling said withdrawn oxygen-rich liquid to lower pressure and mixing the throttled liquid with said cooled expanded air discharged from said expander, passing said mixture and said nitrogen overhead through separate passages in said fractionating device in countercurrent heat exchange relation with the feed air in said fractionating column, and withdrawing heat from said column, withdrawing said mixture from said fractionating device and passing said mixture forming said waste oxygen-rich stream into the cold end of said heat exchanger through one of the first and second passages of the reversing heat exchanger as aforesaid, said heat exchange in said reversing heat exchanger and said fractionation being carried out under conditions such that there is only a small temperature difference between the waste oxygen-rich stream entering the cold end of the exchanger and the cooled feed air stream exiting the cold end of the heat exchanger.

2. The process as defined in claim 1, said withdrawal of a portion of the feed air stream at said intermediate point in said heat exchanger creating a mass imbalance in the cold portion of said heat exchanger and a temperature pinch at the cold end of the exchanger, to effect said small temperature difference between the waste oxygen-rich stream and the cooled feed air stream at the cold end of said exchanger, and ensuring complete sublimation of the solid $CO_2$ by the oxygen-rich waste stream in the respective first and second passages of said heat exchanger by passage of the oxygen-rich waste stream therethrough.

3. The process as defined in claim 1, said feed air being compressed to about 3 atmospheres and said oxygen-rich waste stream being at about 1 atmosphere pressure, and the temperature difference between the waste oxygen-rich stream and the cooled feed air at the cold end of the heat exchanger being about 3° R.

4. The process as defined in claim 1, including withdrawing nitrogen from said fractionating device, passing said nitrogen through a third passage in said heat exchanger in heat exchange relation with said feed air in said exchanger, and withdrawing gaseous nitrogen from said exchanger as product.

5. The process as defined in claim 1, wherein said feed air is passed upwardly in said fractionating column, and said mixture and said nitrogen overhead are passed downwardly throughout the entire length of said column, causing non-adiabatic differential distillation to take place in said column.

6. The process as defined in claim 1, including first passing the portion of feed air stream withdrawn at an intermediate point in said heat exchanger, through a gel trap to remove the last traces of $CO_2$ from said air portion, prior to expanding said withdrawn air portion.

7. The process as defined in claim 4, including diverting a portion of the oxygen-rich liquid withdrawn from said fractionating device after throttling said liquid to lower pressure, diverting a portion of said nitrogen withdrawn from said fractionating device, passing said throttled portion of oxygen-rich liquid through a condenser in heat exchanger relation with said diverted portion of nitrogen, recovering liquid nitrogen as product, withdrawing said oxygen-rich liquid from said condenser and introducing said oxygen-rich liquid, together with said mixture of oxygen-rich liquid and cooled expanded air, into one of said separate passages of said fractionating device.

8. The process as defined in claim 7, including withdrawing an additional portion of the feed air stream at a point in the heat exchanger at a warmer location than and upstream from the portion of the feed air stream withdrawn at an intermediate point in the exchanger, passing said additional portion of said feed air stream to a second expander and cooling said additional portion of said feed air stream, and discharging said cooled additional portion of said feed air stream into the passage containing said waste oxygen-rich stream in said reversing heat exchanger.

9. The process as defined in claim 8, including passing said additional portion of the feed air stream first through a gel trap to remove all traces of $CO_2$ from said additional portion of feed air stream, prior to passage thereof to said second expander.

10. A process for the separation of nitrogen from air, which comprises:

compressing feed air containing water vapor and $CO_2$, to relatively low pressure, passing the compressed feed air stream through a first passage of a reversing heat exchanger in heat exchange relation with an oxygen-rich waste stream passing through a second passage of said heat exchanger, whereby water vapor and $CO_2$ in the feed air are frozen on a surface of said first heat exchange passage, reversing the two streams whereby the oxygen-rich waste stream flows through said first passage and said feed air stream flows through said second passage, causing sublimation or evaporation of said water vapor and said $CO_2$, at the end of this cycle, again reversing the two streams so that the compressed feed air stream passes through said first passage and the oxygen-rich waste stream passes through said second passage, and repeating the cycle at predetermined intervals, withdrawing said cooled feed air stream from the cold end of said exchanger after complete passage therethrough, passing a portion of the cooled feed air stream through a Trumpler pass back through the reversing exchanger, withdrawing at least a fraction of said portion of feed air stream from said Trumpler pass at an intermediate point in said heat exchanger, expanding said withdrawn portion of feed air in an expander to produce work, and discharging cooled expanded air, withdrawing the remainder of said cooled feed air stream from the cold end of said heat exchanger after complete passage therethrough, passing said cooled feed air stream upwardly in a fractionating column in a fractionating device, whereby oxygen-rich liquid is condensed, and a nitrogen overhead is produced, withdrawing said oxygen-rich liquid from said fractionating column, throttling said withdrawn oxygen-rich liquid to lower pressure and mixing the throttled liquid with said cooled expanded air discharged from said expander, passing said mixture and said nitrogen overhead through separate passages in said fractionating device in countercurrent heat exchange relation with the feed air in said fractionating column, and withdrawing heat from said column, withdrawing said mixture from said fractionating device and passing said mixture forming said waste oxygen-rich stream into the cold end of said heat exchanger through one of the first and second passages of the reversing heat exchanger as aforesaid, said heat exchange in said reversing heat exchanger and said fractionation being carried out under conditions such that there is only a small temperature difference between the waste oxygen-rich stream entering the cold end of the exchanger and the cooled feed air stream exiting the cold end of the heat exchanger.

11. The process as defined in claim 10, including withdrawing nitrogen from heat exchange relation with said fractionating column, diverting a portion of the oxygen-rich liquid withdrawn from said fractionating column after throttling said liquid to lower pressure, diverting a portion of said nitrogen withdrawn from heat exchange relation with said column, passing said throttled portion of oxygen-rich liquid through a condenser in heat exchange relation with said diverted portion of nitrogen, recovering liquid nitrogen as product, withdrawing said oxygen-rich liquid from said condenser and introducing said oxygen-rich liquid, together with said mixture of oxygen-rich liquid and cooled expanded air into one of said separate passages of said fractionating device, passing the remainder of said portion of feed air stream from said Trumpler pass through a second Trumpler pass, withdrawing said remainder of said portion of the feed air stream from said second Trumpler pass at a point in the heat exchanger at a warmer location than and upstream from the portion of the feed air stream withdrawn at an intermediate point in the exchanger, passing said remainder of said portion of said feed air stream to a second expander and cooling said last mentioned feed air stream, and discharging said cooled remainder of said portion of said feed air stream into the passage containing said waste oxygen-rich stream in said reversing heat exchanger.

12. A process for the separation of nitrogen from air which comprises:

compressing feed air to a pressure of about 3 atmospheres, passing the compressed feed air stream through a reversing valve and into a first passage of a reversing heat exchanger, passing an oxygen-rich waste stream through a second passage of said heat exchanger, in heat exchange relation with said feed air stream, whereby water vapor and $CO_2$ in the feed air stream are frozen on the surface of the first passage of said reversing exchanger, reversing the two streams, whereby the oxygen-rich waste stream flows through said first passage and said feed air stream flows through said second passage, causing sublimation or evaporation of said water vapor and $CO_2$, at the end of this cycle, again reversing two streams so that the compressed feed air stream passes through said first passage and the oxygen-rich waste stream passes through said second passage, and repeating the cycle at predetermined intervals, withdrawing a portion of the feed air stream at an intermediate point in the exchanger, passing said withdrawn portion of feed air through a gel trap to remove traces of $CO_2$, expanding said withdrawn portion of feed air in an expander, and discharging cooled expanded air, withdrawing the remainder of said cooled feed air stream from the cold end of said exchanger after complete passage therethrough, passing said cooled air stream upwardly throughout the entire length of a fractionating column of a fractionating device, causing partial condensation of said air stream to form a condensed oxygen-rich liquid and a nitrogen overhead, withdrawing said oxygen-rich liquid from said column and throttling said liquid to lower pressure, mixing said throttled oxygen-rich liquid with cooled air discharged from said expander, passing said mixture through one passage of said fractionating device downwardly in heat exchange relation along the entire length of said column, passing said nitrogen overhead downwardly through a second passage in heat exchange relation with said fractionating column along the entire length thereof, withdrawing heat from said column and causing a nonadiabatic fractional distillation to take place in said column, withdrawing said mixture from heat exchange relation with said fractionating column and passing said mixture forming said waste oxygen-rich stream into the cold end of said heat exchanger through one of the reversing passages thereof, withdrawing nitrogen from the second passage in heat exchange relation with said fractionating column, passing said withdrawn nitrogen into a third passage of said reversing exchanger in heat exchange relation with said feed air stream, and withdrawing gaseous nitrogen as product, said heat exchange in said reversing heat exchanger and said fractionation being carried out under conditions such that there is only a small temperature difference between the waste oxygen-rich stream entering the cold end of the exchanger and the cooled feed air stream exiting the cold end of the heat exchanger.

13. The process as defined in claim 12, including diverting a portion of the oxygen-rich liquid withdrawn from said fractionating column after throttling said liquid to lower pressure, diverting a portion of said nitrogen withdrawn from heat exchange relation with said column, passing said throttled portion of oxygen-rich liquid through a condenser in heat exchange relation with said diverted portion of nitrogen, recovering liquid nitrogen as product, withdrawing said oxygen-rich liquid from said condenser and introducing said oxygen-rich liquid, together with said mixture of oxygen-rich liquid and cooled expanded air into said one passage of said fractionating device, withdrawing an additional portion of the feed air stream at a point in the heat exchanger at a warmer location than and upstream from the portion of the feed air stream withdrawn at an intermediate point in the exchanger, passing said additional portion of said feed air stream to a second expander and cooling said additional portion of said feed air stream, and discharging said cooled additional expanded portion of said feed air stream into the passage containing said waste oxygen-rich stream in said reversing heat exchanger.

14. A system for the separation of nitrogen from air, which comprises:

means for compressing feed air containing water vapor and $CO_2$ to relatively low pressure, reversing regenerator means comprising first and second passages, valve means for reversing the flow of feed air alternately from the first to the second passage in said heat exchanger, and vice versa, whereby water vapor and $CO_2$ in the feed air stream frozen on the surface of one of the heat exchange passages, are sublimed and evaporated by reversing the flow of the feed air stream from the first passage to the second passage and the flow of an oxygen-rich waste stream passing, from said second passage, into said first passage, said valve means being operative to repeat the cycle at predetermined intervals, means for withdrawing a portion of the feed air stream at an intermediate point in the exchanger, a check valve, said withdrawn feed air stream passing through said check valve, an expander, conduit means for passing said withdrawn portion of feed air to said expander, means for withdrawing the remainder of said cooled feed air stream from the cold end of said exchanger after complete passage therethrough, a fractionating device including a fractionating column and first and second passages in heat exchange relation with said fractionating column, means for introducing the remainder of said cooled feed air stream into the bottom of said fractionating column for passage upwardly in said column to form an oxygen-rich liquid which condenses in said column and a nitrogen overhead, means for withdrawing oxygen-rich liquid from the bottom of said fractionating column, means for throttling said withdrawn oxygen-rich liquid, means for mixing said throttled oxygen-rich liquid with said cooled expanded air discharged from said expander, means for passing said mixture downwardly through one of said passages in said fractionating device, means for passing said overhead nitrogen downwardly through the other passage of said fractionating device, means for withdrawing nitrogen from the bottom of said last mentioned passage, a third passage in said reversing regenerator, means for introducing said nitrogen withdrawn from said fractionating device into said third passage of said regenerator, means for withdrawing nitrogen product from the warm end of said regenerator, said reversing heat exchange in said reversing heat exchanger, and said fractionation carried out in said fractionating device being operated so that both the waste oxygen-rich stream and the nitrogen product stream passing into said second and third passages at the cold end of said regenerator are at a temperature only a few degrees below the temperature of the feed air withdrawn at the cold end of the regenerative heat exchanger.

15. The system as defined in claim 14, including a gel trap, means for initially passing said portion of feed air stream withdrawn from said exchanger, first through said gel trap, prior to passage of said first portion of said air stream to said expander, to remove all traces of $CO_2$ from said first portion of the feed air stream.

16. The system as defined in claim 14, including means for diverting a portion of the oxygen-rich liquid withdrawn from said column, means for throttling said diverted portion of oxygen-rich liquid to a lower pressure, means for diverting a portion of said nitrogen withdrawn from the bottom of said other passage, a nitrogen condenser, means for passing said throttled portion of oxygen-rich liquid through said nitrogen condenser, means for passing said diverted portion of nitrogen into said nitrogen condenser in heat exchange relation with said oxygen-rich liquid therein, and causing condensation of liquid nitrogen, means for recovering liquid nitrogen as product from said nitrogen condenser, and means for passing said oxygen-rich liquid from said nitrogen condenser into the top of said one of said passages of said fractionating device.

17. The system as defined in claim 16, including means for withdrawing an additional portion of the feed air stream at a point in the reversing exchanger upstream from the portion of the feed air stream withdrawn at an intermediate point in the exchanger, check valve means, means for passing said additional portion of feed air stream through said check valve means, a second expander, means for passing said additional portion of feed air stream into said second expander and cooling said additional portion of said feed air stream, a third check valve means, means for passing said expanded cooled air stream from said second expander through said third check valve means, and means for discharging said cooled expanded additional portion of feed air stream into said waste oxygen-rich stream passing through one of said passages of said reversing regenerator.

18. The system as defined in claim 17, including a second gel trap intermediate second check valve means and said second expander, and means for passing said additional portion of feed air stream first through said gel trap to remove traces of $CO_2$, prior to introduction into said second expander.

* * * * *